US009959964B2

(12) United States Patent
Yun et al.

(10) Patent No.: US 9,959,964 B2
(45) Date of Patent: May 1, 2018

(54) THIN FILM MAGNET INDUCTOR STRUCTURE FOR HIGH QUALITY (Q)-FACTOR RADIO FREQUENCY (RF) APPLICATIONS

(71) Applicant: QUALCOMM Incorporated, San Diego, CA (US)

(72) Inventors: Changhan Hobie Yun, San Diego, CA (US); David Francis Berdy, San Diego, CA (US); Daeik Daniel Kim, Del Mar, CA (US); Chengjie Zuo, Santee, CA (US); Jonghae Kim, San Diego, CA (US); Je-Hsiung Jeffrey Lan, San Diego, CA (US); Mario Francisco Velez, San Diego, CA (US); Niranjan Sunil Mudakatte, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 144 days.

(21) Appl. No.: 14/941,493

(22) Filed: Nov. 13, 2015

(65) Prior Publication Data

US 2017/0140862 A1 May 18, 2017

(51) Int. Cl.

| | |
|---|---|
| ***H01F 5/00*** | (2006.01) |
| ***H01F 27/28*** | (2006.01) |
| ***H01F 10/12*** | (2006.01) |
| ***H01F 41/04*** | (2006.01) |

(52) U.S. Cl.

CPC ..... *H01F 10/12* (2013.01); *H01F 27/2804* (2013.01); *H01F 41/042* (2013.01); *H01F 2027/2809* (2013.01)

(58) Field of Classification Search

CPC ..... H01F 5/00; H01F 27/28; H01F 27/2804
USPC ..... 336/200, 232
See application file for complete search history.

(56) References Cited

U.S. PATENT DOCUMENTS

| | | | | |
|---|---|---|---|---|
| 8,686,522 | B2 | 4/2014 | Webb | |
| 9,041,152 | B2 | 5/2015 | Luo et al. | |
| 2002/0097132 | A1* | 7/2002 | Ahn | H01F 17/0033 336/221 |
| 2008/0136575 | A1* | 6/2008 | Edo | H01F 27/2804 336/200 |
| 2008/0143468 | A1* | 6/2008 | Yokoyama | H01F 1/342 336/200 |
| 2008/0179963 | A1* | 7/2008 | Fouquet | H01F 19/08 307/104 |

(Continued)

*Primary Examiner* — Tsz Chan
(74) *Attorney, Agent, or Firm* — Qualcomm Incorporated/Seyfarth

(57) ABSTRACT

A thin film magnet (TFM) three-dimensional (3D) inductor structure may include a substrate with conductive vias extending through the substrate. The TFM 3D inductor structure may also include a magnetic thin film layer on at least sidewalls of the conductive vias and on a first side and an opposing second side of the substrate. The TFM 3D inductor structure may further include a first conductive trace directly on the magnetic thin film layer on the first side of the substrate and electrically coupling to at least one of the conductive vias. The TFM 3D inductor structure also includes a second conductive trace directly on the magnetic thin film layer on the second side of the substrate and coupled to at least one of the conductive vias.

25 Claims, 10 Drawing Sheets

(56) References Cited

U.S. PATENT DOCUMENTS

| | | | | |
|---|---|---|---|---|
| 2014/0092574 | A1* | 4/2014 | Zillmann | G06F 1/3296 361/782 |
| 2014/0225706 | A1 | 8/2014 | Doyle et al. | |
| 2014/0247269 | A1* | 9/2014 | Berdy | H01F 1/24 345/501 |
| 2015/0200050 | A1 | 7/2015 | Nakao et al. | |

* cited by examiner

THIN FILM MAGNET INDUCTOR STRUCTURE FOR HIGH QUALITY (Q)-FACTOR RADIO FREQUENCY (RF) APPLICATIONS

BACKGROUND

Field

Aspects of the present disclosure relate to semiconductor devices, and more particularly to a thin film magnet inductor structure for high quality (Q)-factor radio frequency (RF) applications.

Background

The process flow for semiconductor fabrication of integrated circuits (ICs) may include front-end-of-line (FEOL), middle-of-line (MOL), and back-end-of-line (BEOL) processes. The front-end-of-line process may include wafer preparation, isolation, well formation, gate patterning, spacer, extension and source/drain implantation, silicide formation, and dual stress liner formation. The middle-of-line process may include gate contact formation. Middle-of-line layers may include, but are not limited to, middle-of-line contacts, vias or other layers within close proximity to the semiconductor device transistors or other like active devices. The back-end-of-line process may include a series of wafer processing steps for interconnecting the semiconductor devices created during the front-end-of-line and middle-of-line processes.

Successful fabrication of modern semiconductor chip products involves an interplay between the materials and the processes employed. In particular, the formation of conductive material plating for the semiconductor fabrication in the back-end-of-line processes is an increasingly challenging part of the process flow. This is particularly true in terms of maintaining a small feature size. The same challenge of maintaining a small feature size also applies to passive on glass (POG) technology, where high-performance components such as inductors and capacitors are built upon a highly insulative substrate that may also have a very low loss.

Passive on glass devices involve high-performance inductor and capacitor components that have a variety of advantages over other technologies, such as surface mount technology or multi-layer ceramic chips that are commonly used in the fabrication of mobile radio frequency (RF) chip designs (e.g., mobile RF transceivers). The design complexity of mobile RF transceivers is complicated by the migration to a deep sub-micron process node due to cost and power consumption considerations. Mobile RF transceiver design is further complicated by added circuit functions to support communication enhancements. Further design challenges for mobile RF transceivers include analog/RF performance considerations, including mismatch, noise and other performance considerations. The design of these mobile RF transceiver includes the use of passive devices to, for example, suppress resonance, and/or to perform filtering, bypassing and coupling in high power, system on chip devices, such as application processors and graphics processors.

SUMMARY

A thin film magnet (TFM) three-dimensional (3D) inductor structure may include a substrate with conductive vias extending through the substrate. The TFM 3D inductor structure may also include a magnetic thin film layer on at least sidewalls of the conductive vias and on a first side and an opposing second side of the substrate. The TFM 3D inductor structure may further include a first conductive trace directly on the magnetic thin film layer on the first side of the substrate and electrically coupling to at least one of the conductive vias. The TFM 3D inductor structure also includes a second conductive trace directly on the magnetic thin film layer on the second side of the substrate and coupled to at least one of the conductive vias.

A method of fabricating a thin film magnet (TFM) three-dimensional (3D) inductor structure may include depositing a magnetic thin film layer directly on a first side and an opposing second side of a substrate and on at least sidewalls of conductive vias extending through the substrate. The method may also include fabricating a first conductive trace directly on the magnetic thin film layer on the first side of the substrate and coupling to at least one of the conductive vias. The method further includes fabricating a second conductive trace directly on the magnetic thin film layer on the second side of the substrate and coupled to at least one of the conductive vias.

A thin film magnet (TFM) three-dimensional (3D) inductor structure may include a substrate with conductive vias extending through the substrate. The TFM 3D inductor structure may also include a magnetic thin film layer on at least sidewalls of the conductive vias and on a first side and an opposing second side of the substrate. The TFM 3D inductor structure may further include a first means for conducting directly on the magnetic thin film layer on the first side of the substrate and electrically coupling to at least one of the conductive vias. The TFM 3D inductor structure also includes a second means for conducting directly on the magnetic thin film layer on the second side of the substrate and coupled to at least one of the conductive vias.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION

Figure 1:
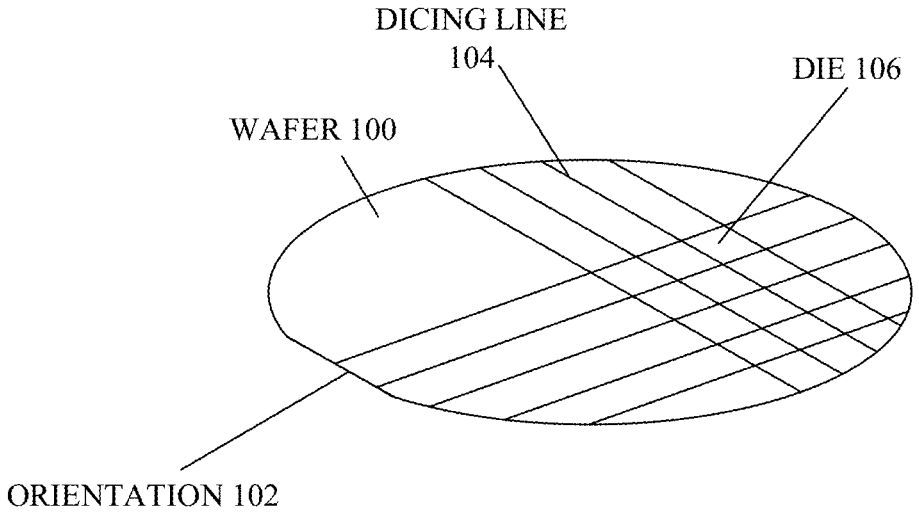
FIG. 1 illustrates a perspective view of a semiconductor wafer in an aspect of the present disclosure.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts. As described herein, the use of the term "and/or" is intended to represent an "inclusive OR," and the use of the term "or" is intended to represent an "exclusive OR."

Mobile radio frequency (RF) chip designs (e.g., mobile RF transceivers) have migrated to a deep sub-micron process node due to cost and power consumption considerations. The design complexity of mobile RF transceivers is further complicated by added circuit functions to support communication enhancements, such as carrier aggregation. Further design challenges for mobile RF transceivers include analog/RF performance considerations, including mismatch, noise and other performance considerations. The design of these mobile RF transceivers includes the use of passive devices, for example, to suppress resonance, and/or to perform filtering, bypassing and coupling.

Passive on glass devices involve high-performance inductor and capacitor components that have a variety of advantages over other technologies, such as surface mount technology or multi-layer ceramic chips. These advantages include being more compact in size and having smaller manufacturing variations. Passive on glass devices also involve a higher Q (or quality factor) value that meets stringent low insertion loss and low power consumption specifications. Devices such as inductors may be implemented as three-dimensional (3D) structures with passive on glass technologies. 3D inductors or other 3D devices may also experience a number of design constraints due to their 3D implementation.

An inductor is an example of an electrical device used to temporarily store energy in a magnetic field within a wire coil according to an inductance value. This inductance value provides a measure of the ratio of voltage to the rate of change of current passing through the inductor. When the current flowing through an inductor changes, energy is temporarily stored in a magnetic field in the coil. In addition to their magnetic field storing capability, inductors are often used in alternating current (AC) electronic equipment, such as radio equipment. For example, the design of mobile RF transceivers includes the use of inductors with improved inductance density while reducing magnetic loss at high frequency (e.g., 700 megahertz (MHz) to 5 gigahertz (GHz) RF range).

Various aspects of the disclosure provide techniques for fabrication of a thin film magnet (TFM) inductor structure. The process flow for semiconductor fabrication of the TFM inductor structure may include front-end-of-line (FEOL) processes, middle-of-line (MOL) processes, and back-end-of-line (BEOL) processes. It will be understood that the term "layer" includes film and is not to be construed as indicating a vertical or horizontal thickness unless otherwise stated. As described herein, the term "substrate" may refer to a substrate of a diced wafer or may refer to a substrate of a wafer that is not diced. Similarly, the terms chip and die may be used interchangeably unless such interchanging would tax credulity.

As described herein, the back-end-of-line interconnect layers may refer to the conductive interconnect layers (e.g., metal one (M1), metal two (M2), metal three (M3), etc.) for electrically coupling to front-end-of-line active devices of an integrated circuit. The back-end-of-line interconnect layers may electrically couple to middle-of-line interconnect layers for, for example, connecting M1 to an oxide diffusion (OD) layer of an integrated circuit. A back-end-of-line first via (V2) may connect M2 to M3 or others of the back-end-of-line interconnect layers.

Aspects of the present disclosure describe a thin film magnet (TFM) three-dimensional (3D) inductor structure for high quality (Q)-factor radio frequency (RF) applications. In one arrangement, the TFM 3D inductor structure includes vias extending through a substrate. The vias may include a thin film magnetic layer on sidewalls of the vias. In addition, the thin film magnetic layer may be disposed on a first side and an opposing second side of the substrate. In this arrangement, a first trace is directly on the thin film magnetic layer on the first side of the substrate and is electrically coupled to some of the vias. In addition, a second trace is directly on the thin film magnetic layer on the second side of the substrate and electrically coupled to some of the vias. By putting magnets in thin film (e.g., 1-5 um) form directly on a substrate, a three-dimensional inductor fabricated with the substrate exhibits a significant improvement in both inductance and Q-factor.

FIG. 1 illustrates a perspective view of a semiconductor wafer in an aspect of the present disclosure. A wafer 100 may be a semiconductor wafer, or may be a substrate material with one or more layers of semiconductor material on a surface of the wafer 100. When the wafer 100 is a semiconductor material, it may be grown from a seed crystal using the Czochralski process, where the seed crystal is dipped into a molten bath of semiconductor material and slowly rotated and removed from the bath. The molten material then crystallizes onto the seed crystal in the orientation of the crystal.

The wafer 100 may be a compound material, such as gallium arsenide (GaAs) or gallium nitride (GaN), a ternary material such as indium gallium arsenide (InGaAs), quaternary materials, or any material that can be a substrate material for other semiconductor materials. Although many of the materials may be crystalline in nature, polycrystalline or amorphous materials may also be used for the wafer 100.

The wafer 100, or layers that are coupled to the wafer 100, may be supplied with materials that make the wafer 100 more conductive. For example, and not by way of limitation, a silicon wafer may have phosphorus or boron added to the wafer 100 to allow for electrical charge to flow in the wafer 100. These additives are referred to as dopants, and provide extra charge carriers (either electrons or holes) within the wafer 100 or portions of the wafer 100. By selecting the areas where the extra charge carriers are provided, which type of charge carriers are provided, and the amount (density) of additional charge carriers in the wafer 100, different types of electronic devices may be formed in or on the wafer 100.

The wafer 100 has an orientation 102 that indicates the crystalline orientation of the wafer 100. The orientation 102 may be a flat edge of the wafer 100 as shown in FIG. 1, or may be a notch or other indicia to illustrate the crystalline orientation of the wafer 100. The orientation 102 may indicate the Miller Indices for the planes of the crystal lattice in the wafer 100.

Once the wafer 100 has been processed as desired, the wafer 100 is divided up along dicing lines 104. The dicing lines 104 indicate where the wafer 100 is to be broken apart or separated into pieces. The dicing lines 104 may define the outline of the various integrated circuits that have been fabricated on the wafer 100.

Once the dicing lines 104 are defined, the wafer 100 may be sawn or otherwise separated into pieces to form the die 106. Each of the die 106 may be an integrated circuit with many devices or may be a single electronic device. The physical size of the die 106, which may also be referred to as a chip or a semiconductor chip, depends at least in part on the ability to separate the wafer 100 into certain sizes, as well as the number of individual devices that the die 106 is designed to contain.

Once the wafer 100 has been separated into one or more die 106, the die 106 may be mounted into packaging to allow access to the devices and/or integrated circuits fabricated on the die 106. Packaging may include single in-line packaging, dual in-line packaging, motherboard packaging, flip-chip packaging, indium dot/bump packaging, or other types of devices that provide access to the die 106. The die 106 may also be directly accessed through wire bonding, probes, or other connections without mounting the die 106 into a separate package.

Figure 2:
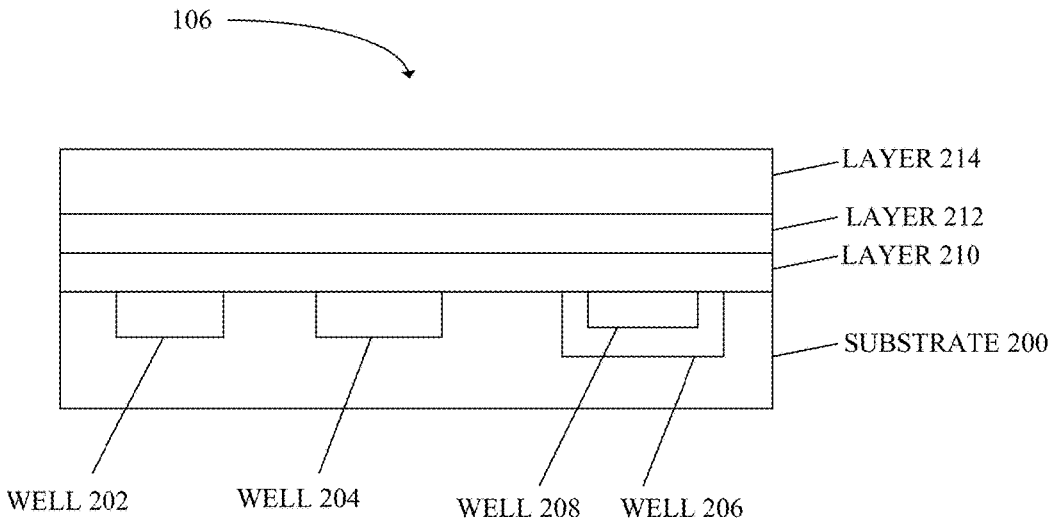
FIG. 2 illustrates a cross-sectional view of a die in accordance with an aspect of the present disclosure.

FIG. 2 illustrates a cross-sectional view of a die 106 in accordance with an aspect of the present disclosure. In the die 106, there may be a substrate 200, which may be a semiconductor material and/or may act as a mechanical support for electronic devices. The substrate 200 may be a doped semiconductor substrate, which has either electrons (designated N-channel) or holes (designated P-channel) charge carriers present throughout the substrate 200. Subsequent doping of the substrate 200 with charge carrier ions/atoms may change the charge carrying capabilities of the substrate 200.

Within a substrate 200 (e.g., a semiconductor substrate), there may be wells 202 and 204, which may be the source and/or drain of a field-effect transistor (FET), or wells 202 and/or 204 may be fin structures of a fin structured FET (FinFET). Wells 202 and/or 204 may also be other devices (e.g., a resistor, a capacitor, a diode, or other electronic devices) depending on the structure and other characteristics of the wells 202 and/or 204 and the surrounding structure of the substrate 200.

The semiconductor substrate may also have a well 206 and a well 208. The well 208 may be completely within the well 206, and, in some cases, may form a bipolar junction transistor (BJT). The well 206 may also be used as an isolation well to isolate the well 208 from electric and/or magnetic fields within the die 106.

Layers (e.g., 210 through 214) may be added to the die 106. The layer 210 may be, for example, an oxide or insulating layer that may isolate the wells (e.g., 202-208) from each other or from other devices on the die 106. In such cases, the layer 210 may be silicon dioxide, a polymer, a dielectric, or another electrically insulating layer. The layer 210 may also be an interconnection layer, in which case it may comprise a conductive material such as copper, tungsten, aluminum, an alloy, or other conductive or metallic materials.

The layer 212 may also be a dielectric or conductive layer, depending on the desired device characteristics and/or the materials of the layers (e.g., 210 and 214). The layer 214 may be an encapsulating layer, which may protect the layers (e.g., 210 and 212), as well as the wells 202-208 and the substrate 200, from external forces. For example, and not by way of limitation, the layer 214 may be a layer that protects the die 106 from mechanical damage, or the layer 214 may be a layer of material that protects the die 106 from electromagnetic or radiation damage.

Electronic devices designed on the die 106 may comprise many features or structural components. For example, the die 106 may be exposed to any number of methods to impart dopants into the substrate 200, the wells 202-208, and, if desired, the layers (e.g., 210-214). For example, and not by way of limitation, the die 106 may be exposed to ion implantation, deposition of dopant atoms that are driven into a crystalline lattice through a diffusion process, chemical vapor deposition, epitaxial growth, or other methods. Through selective growth, material selection, and removal of portions of the layers (e.g., 210-214), and through selective removal, material selection, and dopant concentration of the substrate 200 and the wells 202-208, many different structures and electronic devices may be formed within the scope of the present disclosure.

Further, the substrate 200, the wells 202-208, and the layers (e.g., 210-214) may be selectively removed or added through various processes. Chemical wet etching, chemical mechanical planarization (CMP), plasma etching, photoresist masking, damascene processes, and other methods may create the structures and devices of the present disclosure.

Figure 3:
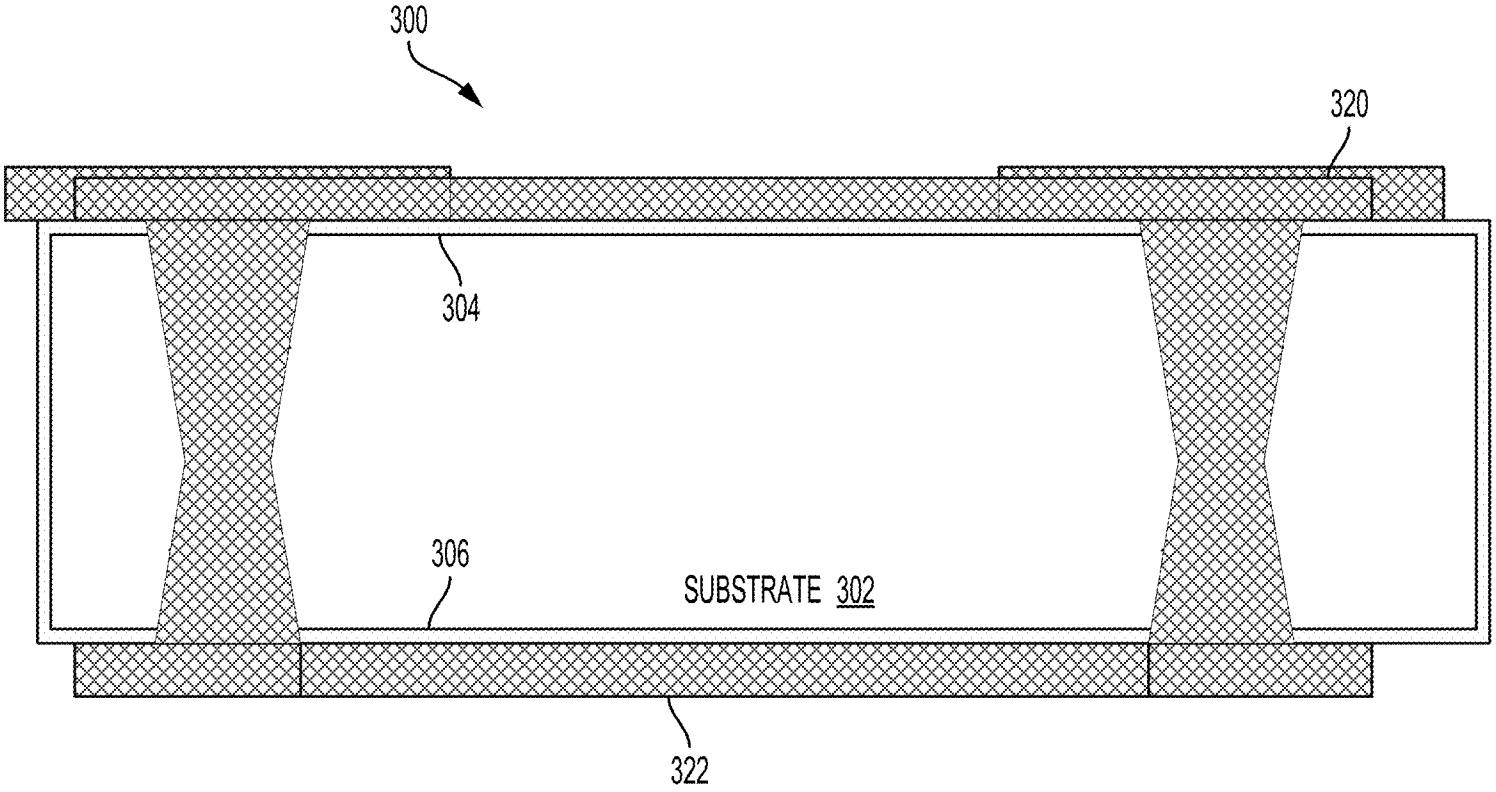
FIG. 3 illustrates a three-dimensional inductor structure prior to incorporation of a thin film magnetic layer according to an aspect of the present disclosure.

FIG. 3 illustrates a three-dimensional (3D) inductor structure 300 prior to incorporation of a thin film magnetic layer according to an aspect of the present disclosure. Representatively, the 3D inductor structure 300 is composed of a substrate 302 including a first surface 304 and a second surface 306 opposite the first surface 304. The substrate may be composed of a glass substrate, such as a solid glass substrate or a coreless substrate. The 3D inductor structure 300 also includes a first conductive via 310-1 and a second conductive via 310-2 extending through the substrate 302. Via openings for the first conductive via 310-1 and the second conductive via 310-2 may be opened using a laser to provide sidewalls with a sidewall slope of approximately 85° according to an hour-glass shape. In addition, the first conductive via 310-1 and the second conductive via 310-2 are fabricated with a predetermined diameter (e.g., 65-80 microns). Although illustrated according the hour-glass shape, aspects of the present disclosure are not limited to this configuration of the conductive vias (e.g., 310-1 and 310-2).

In this arrangement, a first conductive trace 320 is fabricated directly on the first surface 304 of the substrate 302 and electrically coupled the first contact via 310-1 and or the second contact via 310-2. In addition, a second conductive trace 322 is fabricated directly on the second surface 306 opposite the first surface 304 of the substrate 302 and electrically coupled the first contact via 310-1 and/or the second contact via 310-2. The electrically coupling of the first conductive trace 320, the second conductive trace 322, the first contact via 310-1 and the second contact via 310-2 is performed according to a desired configuration of the 3D inductor structure 300. The inductance of the 3D inductor structure 300 may be configured by adjusting a pitch (e.g., 140 microns) between the inductor traces (e.g., the first conductive trace 320 and the second conductive trace 322), which is distinct from conventional designs in which inductors are closely wound.

As noted above, the design of future mobile RF transceivers involves the use of inductors with improved inductance density while reducing magnetic loss at high frequency (e.g., 700 gigahertz (GHz) RF range). An inductance density of the 3D inductor structure 300 may be improved by using a bulk magnetic core (not shown) within the substrate. Another option is the use of an air core within the substrate 302. The use of a bulk magnetic core within the substrate 302 of the 3D inductor provides improved inductance (e.g., 6.7 nanohenries (nH) at 1 gigahertz (GHz)) and an improved Q-factor (e.g., 96 at 1 GHz). Unfortunately, the use of the bulk magnetic core comes at the price of increased eddy currents. Eddy currents are unwanted circular electric currents induced within conductors by a changing magnetic field in the conductor due to Faraday's law of induction. Aspects of the present disclosure include the placement of magnets in thin film (e.g., 1-5 microns) form directly on a substrate to provide a three-dimensional inductor that exhibits a significant improvement in both inductance and Q-factor, for example, as shown in FIGS. 4A and 4B.

Figure 4A:
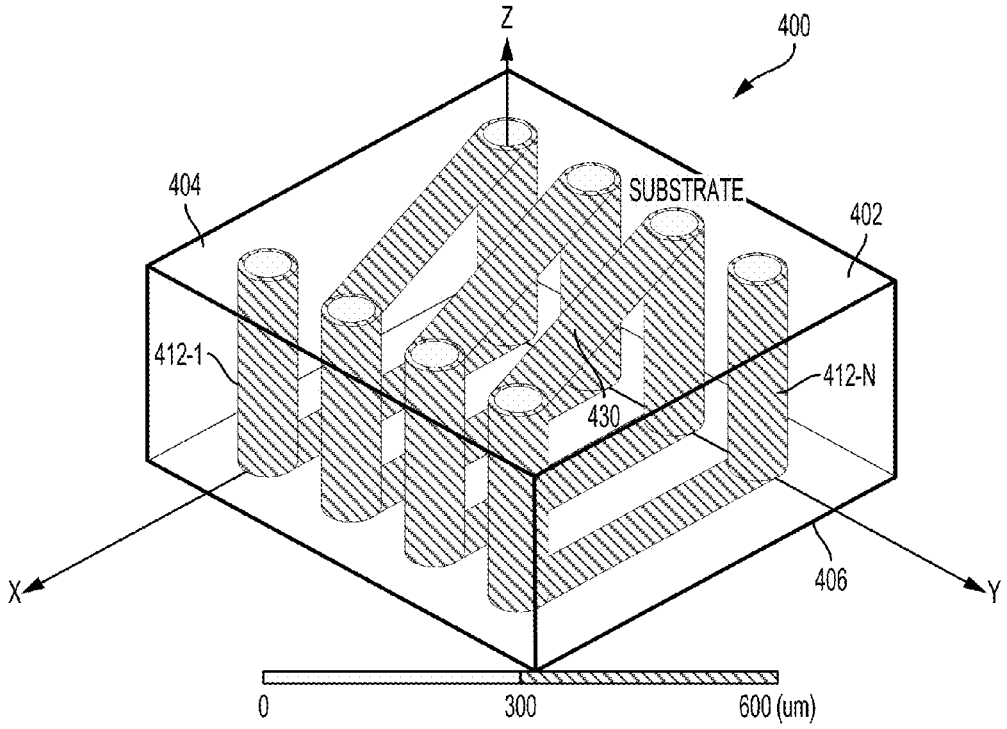
FIGS. 4A to 4C illustrate a thin film magnet (TFM) three-dimensional (3D) inductor structure according to aspects of the present disclosure.
Figure 4B:
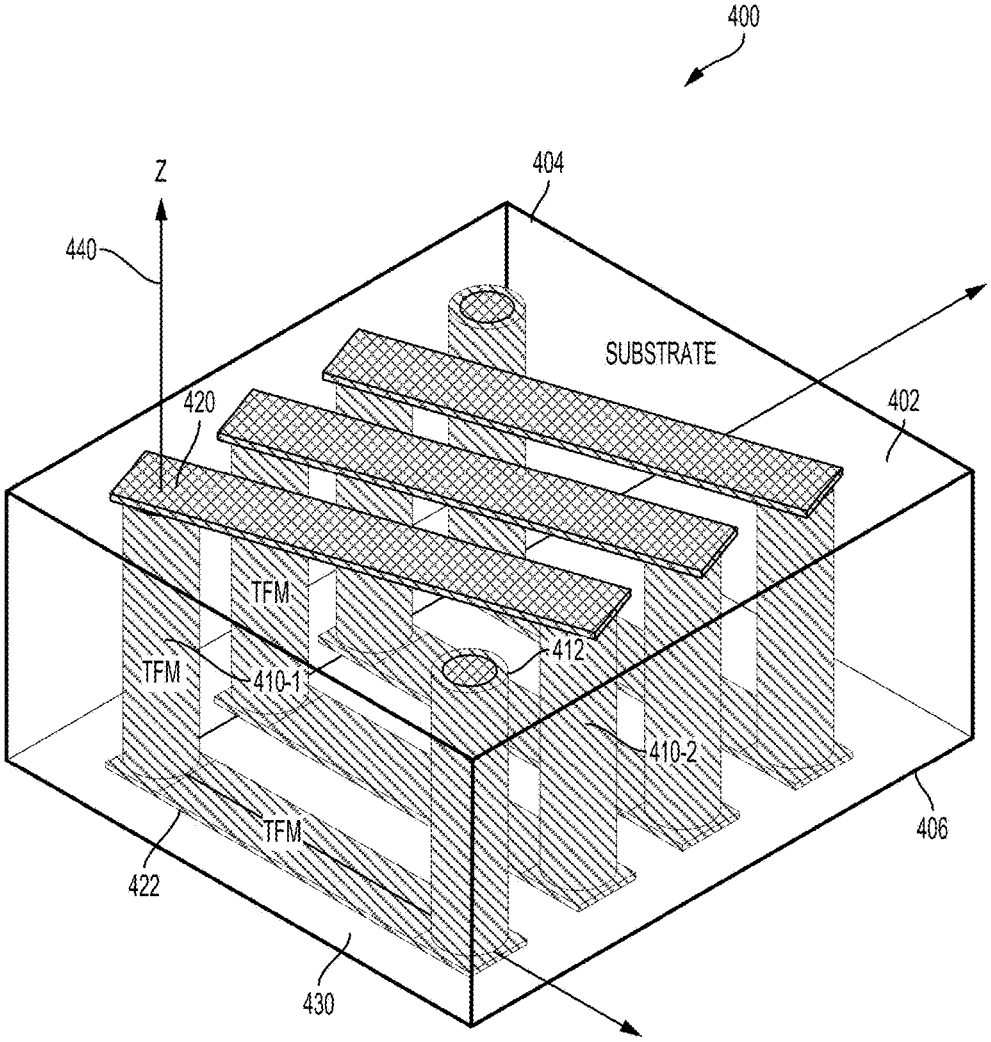
Figure 4C:
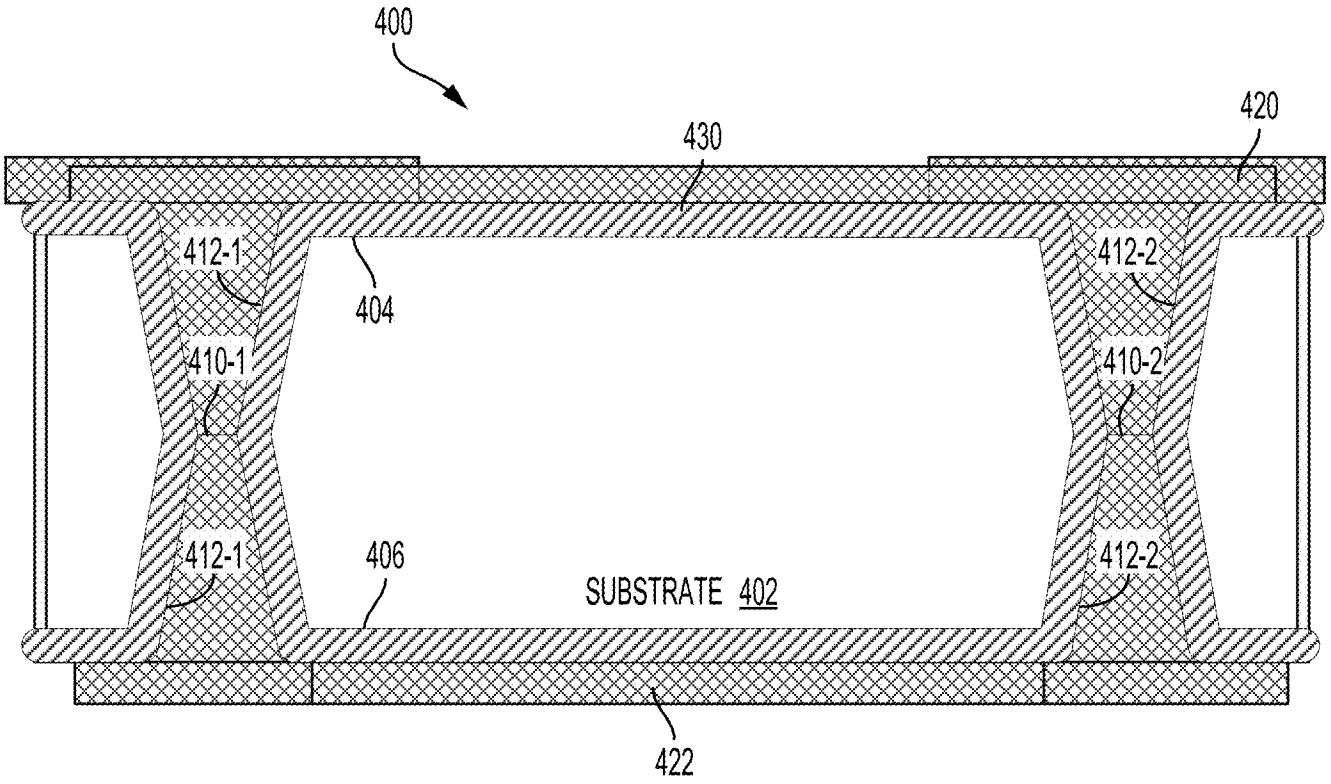

FIGS. 4A to 4C illustrate fabrication of a thin film magnet (TFM) three-dimensional (3D) inductor structure according to aspects of the present disclosure. The arrangement shown in FIG. 4A illustrates a preliminary step in the fabrication of the TFM 3D inductor structure 400. In this aspect of the disclosure, a first side 404 and a second side 406 of a substrate 402 are blanket coated with a thin film magnetic layer 430. In addition, sidewalls 412 (412-1, . . . , 412-N) of via openings are coated with the thin film magnetic layer 430. A photo resist is then deposited and the thin film magnetic layer 430 is etched according to, for example, a pattern for subsequently deposited traces. The deposition of a conductive layer on the thin film magnetic layer 430 and within the via openings is then performed to complete the TFM 3D inductor structure 400, as shown in FIGS. 4B and 4C.

In the arrangement shown in FIG. 4B, the TFM 3D inductor structure 400 is composed of a substrate 402 including a first surface 404 and a second surface 406 opposite the first surface 404. The TFM 3D inductor structure 400 also includes a first conductive via 410-1 and a second conductive via 410-2 (e.g., an adjacent second conductive via) extending through the substrate 402. In this aspect of the present disclosure, a thin film magnetic layer 430 lines the first conductive via 410-1 and the second conductive via 410-2. In this arrangement, a first conductive trace 420 is directly on the thin film magnetic layer 430 disposed on the first side 404 of the substrate 402. In addition, a second conductive trace 422 is directly on the thin film magnetic layer 430 on the opposing side 406 of the substrate 402. Placing magnets in a thin film (e.g., 1-5 microns) form directly on the substrate 402 significantly improves both an inductance and a quality factor of the TFM 3D inductor structure 400. A cross sectional view of the TFM 3D inductor structure 400 along a z-axis 440 is shown in FIG. 4C.

As shown in FIG. 4C, a thin film magnetic layer 430 is disposed on the first side 404 and the second side 406 of the substrate 402. In addition, the thin film magnetic layer 430 is on sidewalls 412 of the first conductive via 410-1 and the second conductive via 410-2. Via openings for the first conductive via 410-1 and the second conductive via 410-2 may be opened using a laser to provide sidewalls with a sidewall slope of approximately 85° according to an hourglass shape similar to the configuration shown in FIG. 3. In one arrangement, the thin film magnetic layer 430 lines the first conductive via 410-1 and the second conductive via 410-2. Placing magnets in a thin film (e.g., 1-5 microns) form directly on the substrate 402 significantly improves both an inductance and a quality factor of the TFM 3D inductor structure 400.

In aspects of the present disclosure, the thin film magnetic layer 430 may be composed of a non-conductive material and/or a conductive oxide material, such as a ferromagnetic material (e.g., $Fe_2O_3$). $Fe_2O_3$ is generally referred to as ferrite may be used as the thin film magnetic layer 430. In this arrangement, impurities may be added to the thin film magnetic layer 430 to improve relative permeability and further boost the inductance. The impurities may include, but are not limited to, nickel (Ni), zinc (Zn), copper (Cu), and cobalt (Co). For example, the thin film magnetic layer 430 may be composed of $Ni_{(x)}Zn_{(y)}Cu_{(z)}Fe_2O_3$, with x, y, and z between 0 and 1. Otherwise, a dielectric insulating layer is deposited on the thin film magnetic layer prior to depositing the conductive trances.

In the arrangement shown in FIG. 4C in which the thin film magnetic layer 430 may be composed of a non-conductive material, a first conductive trace 420 is directly on the thin film magnetic layer 430 disposed on the first side 404 of the substrate 402. In addition, a second conductive trace 422 is directly on the thin film magnetic layer 430 on the opposing side 406 of the substrate 402. In this arrangement, the thin film magnetic layer 430 on the first side 404 of the substrate 402 is electrically coupled to the thin film magnetic layer 430 on sidewalls 412 of the first conductive via 410-1 and/or the second conductive via 410-2. Similarly, the thin film magnetic layer 430 on the second side 406 of the substrate 402 is electrically coupled to the thin film magnetic layer 430 on sidewalls 412 of the first conductive via 410-1 and/or the second conductive via 410-2. The inductance of the 3D inductor structure 400 may be configured by adjusting a pitch (e.g., 140 microns) between the inductor traces (e.g., the first conductive trace 420 and the second conductive trace 422), which is distinct from conventional designs in which inductors are closely wound.

Figure 5A:
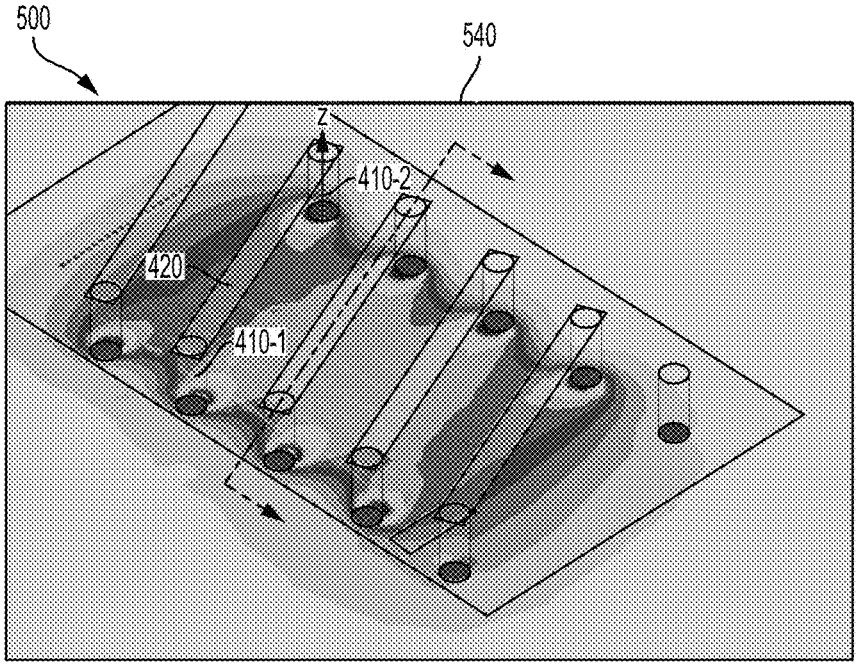
FIGS. 5A and 5B show a perspective view and a cross sectional view of the TFM 3D inductor structure of FIGS. 4B and 4C according to aspects of the present disclosure.
Figure 5B:
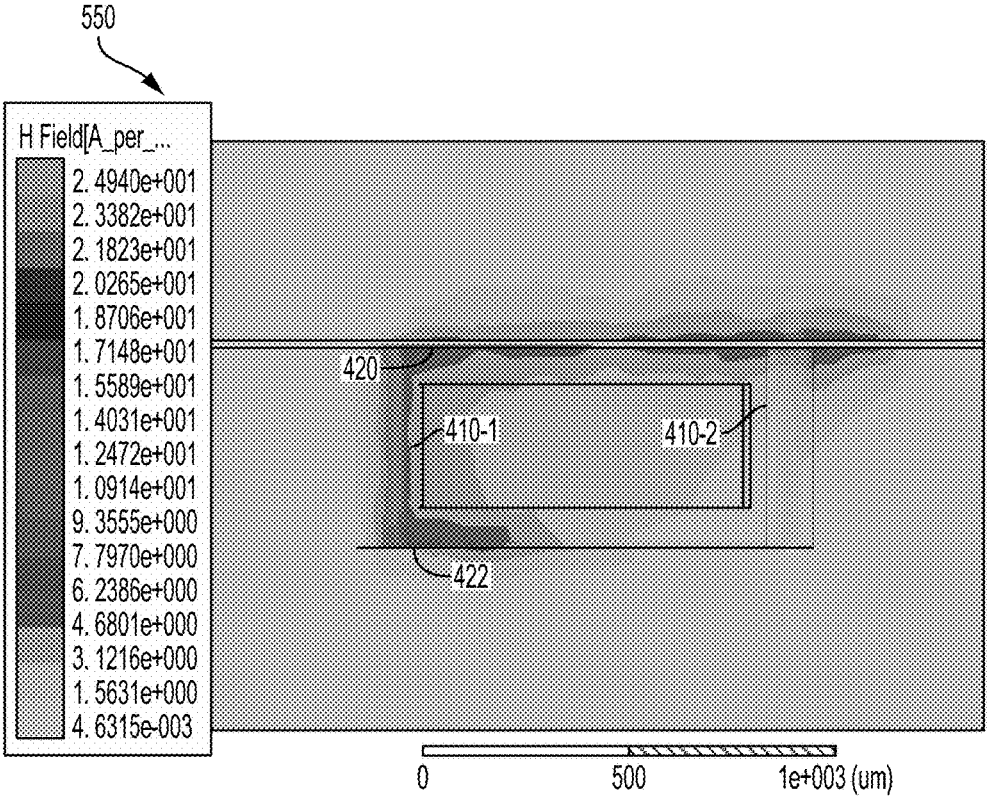

FIGS. 5A and 5B show a perspective view and a cross sectional view of the TFM 3D inductor structure 400 of FIGS. 4B and 4C according to aspects of the present disclosure. FIG. 5A shows a perspective view 500 of the TFM 3D inductor structure 400 including the first conductive trace 420 coupled to the first conductive via 410-1 and the second conductive via 410-2. In FIG. 5A, the perspective view 500 shows a magnetic flux (field) exhibited by the TFM 3D inductor structure 400 of FIGS. 4A and 4B. The magnetic flux is further illustrated in the cross-section taken along the line 540 in FIG. 5B.

As shown in the cross-section view 550 of FIG. 5B, the magnetic flux is strongest near the conductive traces (e.g., 420). According to FIG. 5B, magnetic loss at higher frequencies (e.g., 700 MHz RF range) is reduced when using the TFM 3D inductor structure 400 of FIGS. 4A and 4B, as shown by the magnetic field intensity, H, in units of Ampere/meter.

In contrast to conventional inductors, which specify a predetermined distance between an inductor trace and any magnets, an improved 3D inductor design according to aspects of the present disclosure places magnets in a thin film (e.g., 1-5 microns thick) directly on a substrate (e.g., glass with near zero loss) and within through substrate vias. The direct placement of the thin film magnets on the substrate eliminates eddy currents, which lead to magnetic loss, especially at higher RF frequencies. The improved thin film magnet 3D inductors are arranged with a predetermined pitch (e.g., 140 microns) from via to via and a predetermined diameter (e.g., 65-80 microns). In this arrangement, a TFM 3D inductor exhibits both improved inductance as well as an improved quality (Q)-factor while reducing magnetic loss at high frequency (e.g., 700 MHz RF range) to the design of mobile RF transceivers.

Figure 6:
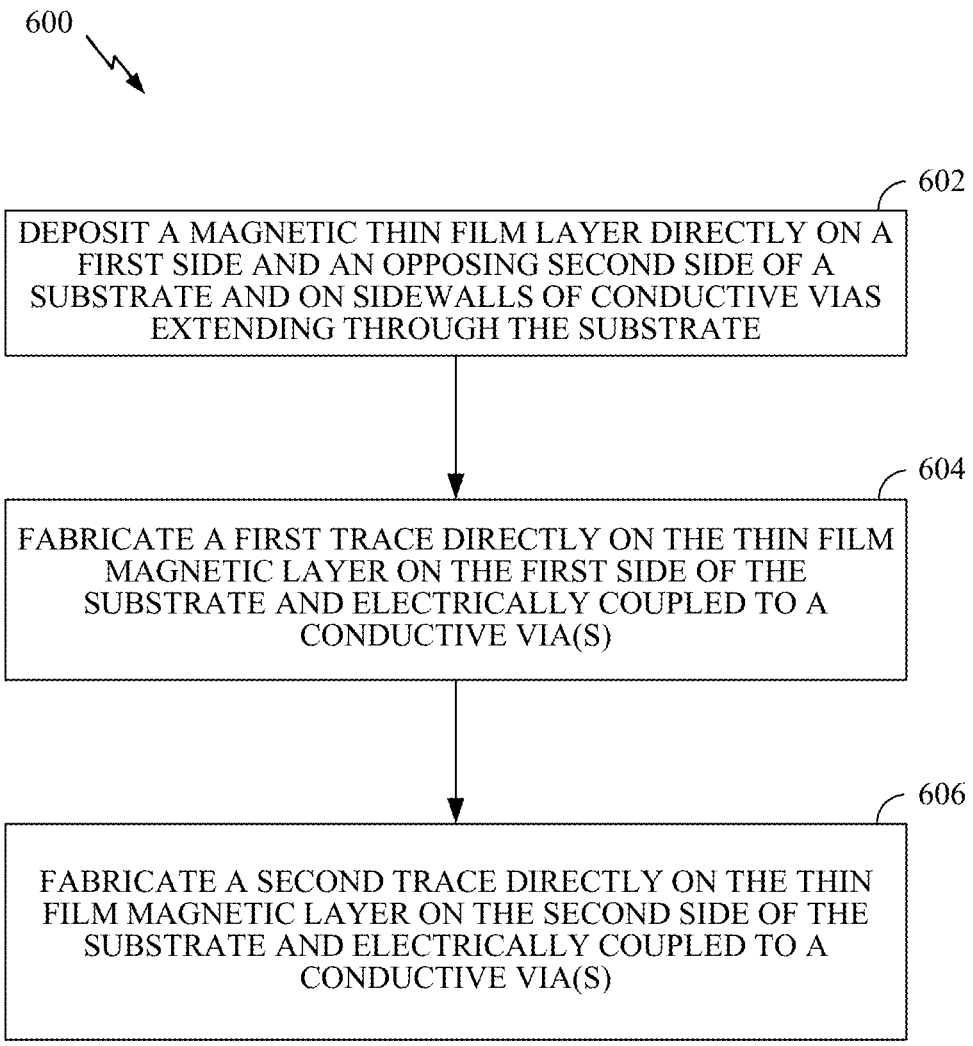
FIG. 6 is a process flow diagram illustrating a method of fabricating a TFM 3D inductor structure according to an aspect of the present disclosure.

FIG. 6 is a flow diagram illustrating a method 600 of fabricating a thin-film magnet (TFM) three-dimensional 3D inductor structure according to aspects of the disclosure. At block 602, a magnetic thin film layer is deposited directly on a first side and an opposing second side of a substrate. The magnetic thin film layer is also deposited directly on at least sidewalls of conductive vias extending through the substrate. For example, as shown in FIG. 4C, a thin film magnetic layer 430 is deposited on a first side 404 and an opposing side 406 of a substrate 402. In addition, the thin film magnetic layer 430 is deposited on sidewalls 412 of a first conductive via 410-1 and a second conductive via 410-2. In one arrangement, the thin film magnetic layer 430 lines the first conductive via 410-1 and the second conductive via 410-2. In an alternative configuration, a blanket coating of the thin film magnetic layer 430 is deposited on the substrate 402 and etched according to a deposited photoresist, for example, as shown in FIG. 4A.

Referring again to FIG. 6, at block 604, a first trace is fabricated directly on the magnetic thin film layer on the first side of the substrate and electrically coupled to at least one of the conductive vias. At block 606, a second trace is fabricated directly on the magnetic thin film layer on the second side of the substrate and electrically coupled to at least one of the conductive vias. As shown in FIG. 4C, a first conductive trace 420 is fabricated directly on the thin film magnetic layer 430 disposed on the first side 404 of the substrate 402. In addition, a second conductive trace 422 is fabricated directly on the thin film magnetic layer 430 on the opposing side 406 of the substrate 402.

In aspects of the present disclosure, the first conductive trace 420 is arranged as a self-aligned mask for the thin film magnetic layer 430 on the first side 404 of the substrate 402, and the second conductive trace 422 is arranged as the self-aligned mask for the thin film magnetic layer 430 on the second side 406 of the substrate 402. In this arrangement, a first portion of the thin film magnetic layer 430 on the first side 404 of the substrate 402 is electrically coupled to a portion of the thin film magnetic layer 430 on sidewalls 412 of a first conductive via 410-1 and/or a second conductive via 410-2. Similarly, a second portion of the thin film magnetic layer 430 on the second side 406 of the substrate 402 is electrically coupled to a portion of the thin film magnetic layer 430 on sidewalls 412 of the first conductive via 410-1 and/or the second conductive via 410-2.

In one configuration, a thin-film magnet (TFM) three-dimensional 3D inductor structure is described. The TFM 3D inductor structure includes conductive vias extending through a substrate. The vias may include a magnetic thin film layer on sidewalls of the vias. In addition, the magnetic thin film layer may be disposed on a first side and an opposing second side of the substrate. In this arrangement, a first means for conducting is directly on the magnetic thin film layer on the first side of the substrate and is electrically coupled to at least one of the conductive vias. In addition, a second means for conducting is directly on the magnetic thin film layer on the second side of the substrate and electrically coupled to at least one of the vias. In one aspect of the disclosure, the first conducting means is the first conductive trace 420 of FIGS. 4B and 4C, configured to perform the functions recited by the first conducting means. In this aspect of the disclosure, the second conducting means is the second conductive trace 422 of FIGS. 4B and 4C, configured to perform the functions recited by the second conducting means. In another aspect, the aforementioned means may be a device or any layer configured to perform the functions recited by the aforementioned means.

Mobile radio frequency (RF) chip designs (e.g., mobile RF transceivers) have migrated to a deep sub-micron process node due to cost and power consumption considerations. The design complexity of mobile RF transceivers is further complicated by added circuit functions to support communication enhancements, such as carrier aggregation. Further design challenges for mobile RF transceivers include analog/RF performance considerations, including mismatch, noise and other performance considerations. The design of these mobile RF transceivers includes the use of passive devices, for example, to suppress resonance, and/or to perform filtering, bypassing and coupling.

Passive on glass devices involve high-performance inductor and capacitor components that have a variety of advantages over other technologies, such as surface mount technology or multi-layer ceramic chips. These advantages include being more compact in size and having smaller manufacturing variations. Passive on glass devices also involve a higher Q (or quality factor) value that meets stringent low insertion loss and low power consumption specifications. Devices such as inductors may be implemented as three-dimensional (3D) structures with passive on glass technologies. 3D inductors or other 3D devices may also experience a number of design constraints due to their 3D implementation.

Aspects of the present disclosure describe a thin film magnet (TFM) three-dimensional (3D) inductor structure for high quality (Q)-factor radio frequency (RF) applications. In one arrangement, the TFM 3D inductor structure includes vias extending through a substrate. The vias may include a magnetic thin film layer on sidewalls of the vias. In addition, the magnetic thin film layer may be disposed on a first side and an opposing second side of the substrate. In this arrangement, a first trace is directly on the magnetic thin film layer on the first side of the substrate and is electrically coupled to at least one of the vias. In addition, a second trace is directly on the magnetic thin film layer on the second side of the substrate and electrically coupled to at least one of the vias. By putting magnets in thin film (e.g., 1-5 um) form on the directly on a substrate, a three-dimensional inductor fabricated with the substrate exhibits a significant improvement in both inductance and Q-factor.

Figure 7:
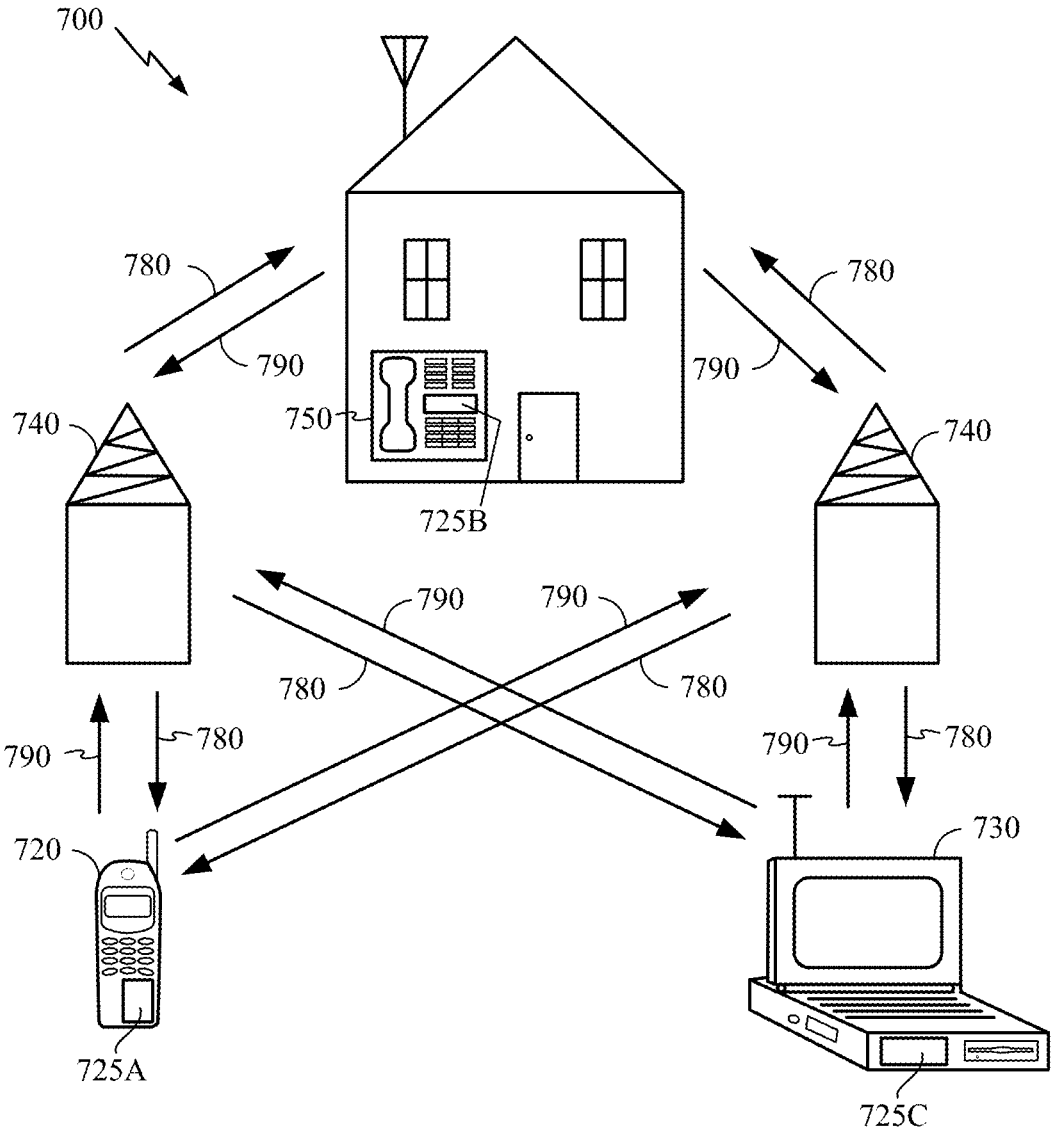
FIG. 7 is a block diagram showing an exemplary wireless communication system in which a configuration of the disclosure may be advantageously employed.

FIG. 7 is a block diagram showing an exemplary wireless communication system 700 in which an aspect of the disclosure may be advantageously employed. For purposes of illustration, FIG. 7 shows three remote units 720, 730, and 750 and two base stations 740. It will be recognized that wireless communication systems may have many more remote units and base stations. Remote units 720, 730, and 750 include IC devices 725A, 725C, and 725B that include the disclosed inductors. It will be recognized that other devices may also include the disclosed inductors, such as the base stations, switching devices, and network equipment. FIG. 7 shows forward link signals 780 from the base station 740 to the remote units 720, 730, and 750 and reverse link signals 790 from the remote units 720, 730, and 750 to base stations 740.

In FIG. 7, remote unit 720 is shown as a mobile telephone, remote unit 730 is shown as a portable computer, and remote unit 750 is shown as a fixed location remote unit in a wireless local loop system. For example, the remote units 720, 730, and 750 may be a mobile phone, a hand-held personal communication systems (PCS) unit, a portable data unit such as a personal digital assistant (PDA), a GPS enabled device, a navigation device, a set top box, a music player, a video player, an entertainment unit, a fixed location data unit such as a meter reading equipment, or a communications device that store or retrieve data or computer instructions, or combinations thereof. Although FIG. 7 illustrates remote units according to the aspects of the disclosure, the disclosure is not limited to these exemplary illustrated units. Aspects of the disclosure may be suitably employed in many devices, which include the disclosed devices.

Figure 8:
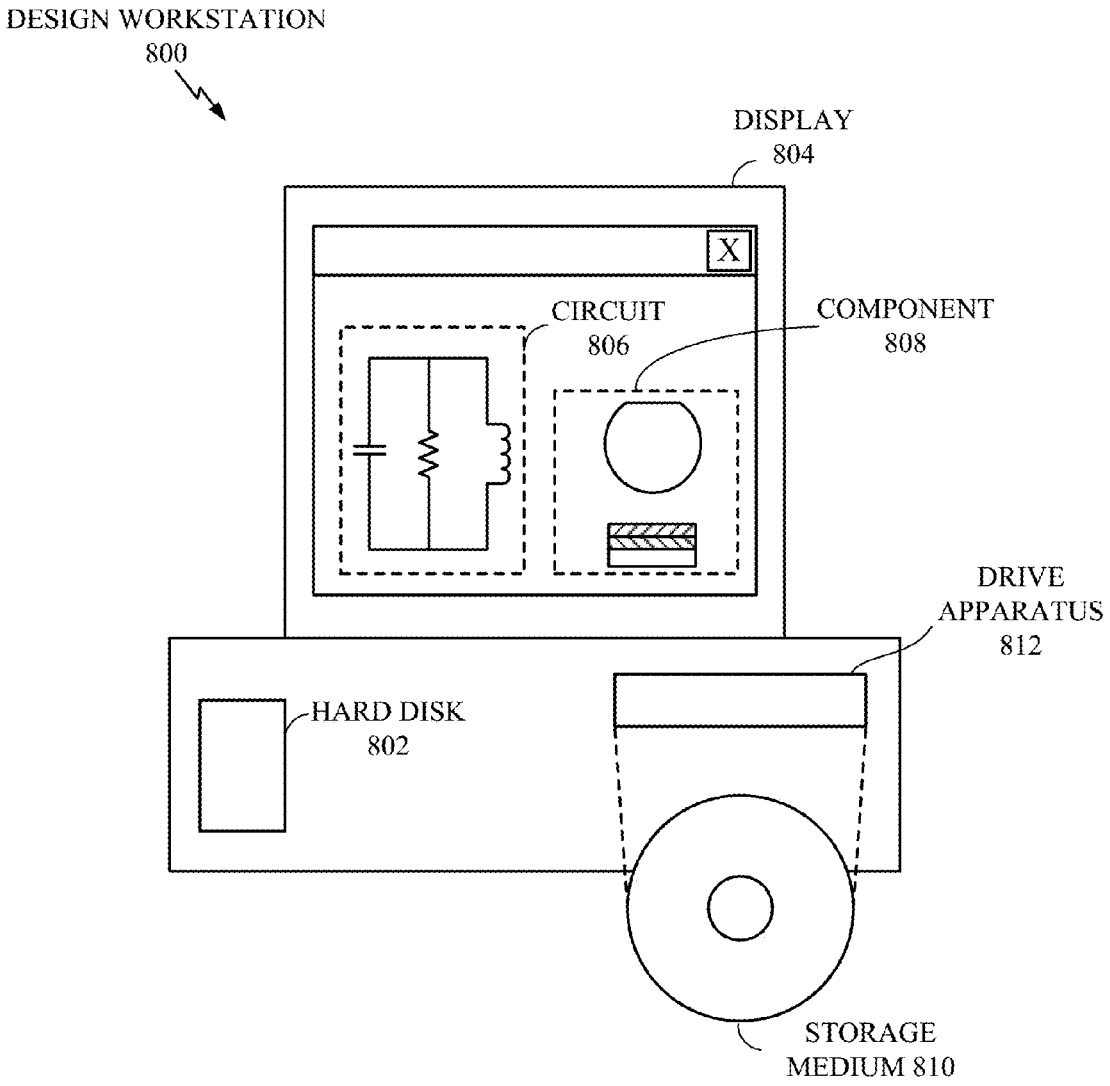
FIG. 8 is a block diagram illustrating a design workstation used for circuit, layout, and logic design of a semiconductor component according to one configuration.

FIG. 8 is a block diagram illustrating a design workstation used for circuit, layout, and logic design of a semiconductor component, such as the inductors disclosed above. A design workstation 800 includes a hard disk 802 containing operating system software, support files, and design software such as Cadence or OrCAD. The design workstation 800 also includes a display 804 to facilitate design of a circuit 806 or a semiconductor component 808 such as an inductor. A storage medium 810 is provided for tangibly storing the design of the circuit 806 or the semiconductor component 808. The design of the circuit 806 or the semiconductor component 808 may be stored on the storage medium 810 in a file format such as GDSII or GERBER. The storage medium 810 may be a CD-ROM, DVD, hard disk, flash memory, or other appropriate device. Furthermore, the design workstation 800 includes a drive apparatus 812 for accepting input from or writing output to the storage medium 810.

Data recorded on the storage medium 810 may specify logic circuit configurations, pattern data for photolithography masks, or mask pattern data for serial write tools such as electron beam lithography. The data may further include logic verification data such as timing diagrams or net circuits associated with logic simulations. Providing data on the storage medium 810 facilitates the design of the circuit 806 or the semiconductor component 808 by decreasing the number of processes for designing semiconductor wafers.

For a firmware and/or software implementation, the methodologies may be implemented with modules (e.g., procedures, functions, and so on) that perform the functions described herein. A machine-readable medium tangibly embodying instructions may be used in implementing the methodologies described herein. For example, software codes may be stored in a memory and executed by a processor unit. Memory may be implemented within the processor unit or external to the processor unit. As used herein, the term "memory" refers to types of long term, short term, volatile, nonvolatile, or other memory and is not to be limited to a particular type of memory or number of memories, or type of media upon which memory is stored.

If implemented in firmware and/or software, the functions may be stored as one or more instructions or code on a computer-readable medium. Examples include computer-readable media encoded with a data structure and computer-readable media encoded with a computer program. Computer-readable media includes physical computer storage media. A storage medium may be an available medium that can be accessed by a computer. By way of example, and not limitation, such computer-readable media can include RAM, ROM, EEPROM, CD-ROM or other optical disk storage, magnetic disk storage or other magnetic storage devices, or other medium that can be used to store desired program code in the form of instructions or data structures and that can be accessed by a computer; disk and disc, as used herein, includes compact disc (CD), laser disc, optical disc, digital versatile disc (DVD) and Blu-ray disc where disks usually reproduce data magnetically, while discs reproduce data optically with lasers. Combinations of the above should also be included within the scope of computer-readable media.

In addition to storage on computer-readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and its advantages have been described in detail, it should be understood that various changes, substitutions and alterations can be made herein without departing from the technology of the disclosure as defined by the appended claims. For example, relational terms, such as "above" and "below" are used with respect to a substrate or electronic device. Of course, if the substrate or electronic device is inverted, above becomes below, and vice versa. Additionally, if oriented sideways, above and below may refer to sides of a substrate or electronic device. Moreover, the scope of the present application is not intended to be limited to the particular configurations of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

Those of skill would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, multiple microprocessors, one or more microprocessors in conjunction with a DSP core, or any other such configuration.

The steps of a method or algorithm described in connection with the disclosure may be embodied directly in hardware, in a software module executed by a processor, or in a combination of the two. A software module may reside in RAM, flash memory, ROM, EPROM, EEPROM, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can include RAM, ROM, EEPROM, CD-ROM or other optical disk storage, magnetic disk storage or other magnetic storage devices, or any other medium that can be used to carry or store specified program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD) and Blu-ray disc where disks usually reproduce data magnetically, while discs reproduce data optically with lasers. Combinations of the above should also be included within the scope of computer-readable media.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "a step for."

What is claimed is:

1. A thin film magnet (TFM) three-dimensional (3D) inductor structure, comprising:

a substrate;

a plurality of via openings through the substrate;

a magnetic thin film layer directly lining the plurality of via openings and on a first side and an opposing second side of the substrate;

a plurality of conductive vias extending through the plurality of via openings and directly on the magnetic thin film layer lining the plurality of via openings;

a first conductive trace directly on the magnetic thin film layer on the first side of the substrate and electrically coupling to at least one of the plurality of conductive vias; and a second conductive trace directly on the magnetic thin film layer on the second side of the substrate and coupled to at least one of the plurality of conductive vias.

2. The TFM 3D inductor structure of claim 1, in which a thickness of the magnetic thin film layer is within a range of one (1) to five (5) microns.

3. The TFM 3D inductor structure of claim 1, in which the first conductive trace is arranged as a self-aligned mask for the magnetic thin film layer on the first side of the substrate and the second conductive trace is arranged as the self-aligned mask for the magnetic thin film layer on the second side of the substrate.

4. The TFM 3D inductor structure of claim 1, in which the substrate comprises a blanket coating of the magnetic thin film layer on the substrate.

5. The TFM 3D inductor structure of claim 1, further comprising a dielectric insulating layer on the magnetic thin film layer.

6. The TFM 3D inductor structure of claim 5, in which the magnetic thin film layer comprises a non-conductive material.

7. The TFM 3D inductor structure of claim 5, in which the magnetic thin film layer comprises a conductive oxide material.

8. The TFM 3D inductor structure of claim 1, in which the magnetic thin film layer on the first side of the substrate is directly coupled to the magnetic thin film layer on the second side of the substrate through a first portion of the magnetic thin film layer within a first conductive via and a second portion of the magnetic thin film layer within an adjacent second conductive via of the plurality of conductive vias.

9. The TFM 3D inductor structure of claim 1, in which the substrate comprises a glass substrate or a coreless substrate.

10. The TFM 3D inductor structure of claim 1, incorporated into at least one of a music player, a video player, an entertainment unit, a navigation device, a communications device, a personal digital assistant (PDA), a fixed location data unit, and a computer.

11. A method of fabricating a thin film magnet (TFM) three-dimensional (3D) inductor structure, comprising:

fabricating a plurality of via openings through a substrate;

depositing a magnetic thin film layer directly on a first side and an opposing second side of the substrate, and directly lining the plurality of via openings in the substrate with the magnetic thin film layer;

depositing a conductive material in the plurality of via openings and directly on the magnetic thin film layer lining the plurality of via openings to form a plurality of conductive vias extending through the substrate;

fabricating a first conductive trace directly on the magnetic thin film layer on the first side of the substrate and coupling to at least one of the plurality of conductive vias; and fabricating a second conductive trace directly on the magnetic thin film layer on the second side of the substrate and coupled to at least one of the plurality of conductive vias.

12. The method of claim 11, in which depositing the magnetic thin film layer comprises:

blanket coating the substrate with the magnetic thin film layer; and depositing a dielectric insulating layer on the magnetic thin film layer.

13. The method of claim 11, further comprises patterning the magnetic thin film layer by etching using the first conductive trace arranged as a self-aligned mask for the magnetic thin film layer on the first side of the substrate and the second conductive trace arranged as the self-aligned mask for the magnetic thin film layer on the second side of the substrate.

14. The method of claim 11, further comprising incorporating the TFM 3D inductor structure into at least one of a music player, a video player, an entertainment unit, a navigation device, a communications device, a personal digital assistant (PDA), a fixed location data unit, and a computer.

15. A three-dimensional (3D) inductor structure, comprising:

a substrate;

a plurality of via openings through the substrate;

a magnetic thin film layer directly lining the plurality of via openings and on a first side and an opposing second side of the substrate;

a plurality of conductive vias extending through the plurality of via openings and directly on the magnetic thin film layer lining the plurality of via openings;

a first means for conducting directly on the thin film magnetic layer on the first side of the substrate and coupling to at least one of the plurality of conductive vias; and a second means for conducting directly on the thin film magnetic layer on the second side of the substrate and coupled to at least one of the plurality of conductive vias.

16. The 3D inductor structure of claim 15, in which a thickness of the thin film magnetic layer is within a range of one (1) to five (5) microns.

17. The 3D inductor structure of claim 15, in which the first conducting means is arranged as a self-aligned mask for the thin film magnetic layer on the first side of the substrate and the second conducting means is arranged as the self-aligned mask for the thin film magnetic layer on the second side of the substrate.

18. The 3D inductor structure of claim 15, further comprising a dielectric insulating layer.

19. The 3D inductor structure of claim 15, in which the thin film magnetic layer comprises a non-conductive material.

20. The 3D inductor structure of claim 15, in which the thin film magnetic layer comprises a conductive oxide material.

21. The 3D inductor structure of claim 15, in which the thin film magnetic layer on the first side of the substrate is directly coupled to the thin film magnetic layer on the second side of the substrate through a first portion of the thin film magnetic layer within a first conductive via and a second portion of the thin film magnetic layer within an adjacent second conductive via of the plurality of conductive vias.

22. The 3D inductor structure of claim 15 in which the substrate comprises a solid glass substrate or a coreless substrate.

23. The 3D inductor structure of claim 15, incorporated into at least one of a music player, a video player, an entertainment unit, a navigation device, a communications device, a personal digital assistant (PDA), a fixed location data unit, and a computer.

24. A method of fabricating a three-dimensional (3D) inductor structure, comprising:

a step for fabricating a plurality of via openings through a substrate;

a step for depositing a magnetic thin film layer directly on a first side and an opposing second side of the substrate, and directly lining the plurality of via openings in the substrate with the magnetic thin film layer;

a step for depositing a conductive material in the plurality of via opening and directly on the magnetic thin film layer lining the plurality of via openings to form a plurality of conductive vias extending through the substrate;

a step for fabricating a first trace directly on the magnetic thin film layer on the first side of the substrate and coupling to at least one of the plurality of conductive vias; and a step for fabricating a second trace directly on the magnetic thin film layer on the second side of the substrate and coupled to at least one of the plurality of conductive vias.

25. The method of claim 24, further comprising a step for incorporating the 3D inductor structure into at least one of a music player, a video player, an entertainment unit, a navigation device, a communications device, a personal digital assistant (PDA), a fixed location data unit, and a computer.

* * * * *